US005597079A

United States Patent [19]

Konop

[11] Patent Number: 5,597,079

[45] Date of Patent: Jan. 28, 1997

[54] DIRECTIONAL INDICATING DEVICE FOR DETECTING IMPROPER ORIENTATION OF A HOIST LIFTING LINE

[75] Inventor: Jeffrey A. Konop, Grafton, Wis.

[73] Assignee: Harnischfeger Corporation, Milwaukee, Wis.

[21] Appl. No.: 518,697

[22] Filed: Aug. 24, 1995

[51] Int. Cl.[6] ..... B66C 13/06

[52] U.S. Cl. ..... 212/273; 212/282

[58] Field of Search ..... 212/273, 282, 212/281; 37/906

[56] References Cited

U.S. PATENT DOCUMENTS

| | | | |
|---|---|---|---|
| 2,806,610 | 9/1957 | Goertz | 212/273 |
| 4,135,632 | 1/1979 | Berkel | 37/906 |
| 4,258,484 | 3/1981 | Lansard | 212/282 |
| 4,273,243 | 6/1981 | Locher | 212/273 |

FOREIGN PATENT DOCUMENTS

| | | | |
|---|---|---|---|
| 224010 | 6/1985 | Germany | 212/273 |
| 1142427 | 2/1985 | U.S.S.R. | 212/273 |

*Primary Examiner*—Thomas J. Brahan
*Attorney, Agent, or Firm*—Richard C. Ruppin

[57] ABSTRACT

An indicating device is provided which includes a pivotal member mounted on a base plate attached to the frame of the trolley on which the hoist is supported, and a pair of spaced apart projections extending from the pivotal member and between which a rope for lifting a load is disposed at a desired orientation relative to the vertical. Movement of the rope from the desired orientation will cause it to engage one of the rods and move the rod along with the pivotal member in one of two opposite directions depending on the direction of movement of the rope from its desired orientation. A pair of fixed members are also mounted on the base plate and are each positioned in a different one of the two opposite directions of movement of the pivotal member. Sensing detectors are mounted on the fixed members and are responsive to movement of the pivotal member when engaged and moved by the rope to indicate the movement and direction of the pivotal member and thereby the movement and direction of movement of the rope from the desired orientation.

14 Claims, 4 Drawing Sheets

10
44
50
64
66
68
72
76
80
82
84
88
90
92
94
96
98
100
104
106
107
108
110
112
114
116
118
120
122

DIRECTIONAL INDICATING DEVICE FOR DETECTING IMPROPER ORIENTATION OF A HOIST LIFTING LINE

BACKGROUND OF THE INVENTION

The present invention relates to hoist mechanisms having a hoist lift line and upper and bottom sheave blocks that can become vertically misaligned.

An overhead crane includes a trolley supported by wheels for travel on elevated rails. The trolley has a frame on which a hoist mechanism is mounted. The hoist includes a rotatable hoist lift drum driven by a prime mover. A main lift line such as a rope, usually fabricated of wire, is connected to the lift drum for raising and lowering a load in response to a control actuated by an operator. The wire rope is reeved through upper and lower sheave block assemblies, and a lifting hook is secured to the lower sheave block. An operation station is often located on the crane high above the floor over which the crane travels.

For proper lifting of a load, the lower sheave block must be vertically aligned with the upper sheave block so as to be directly underneath it when the load is lifted. When hitching up a load, the rigger can easily pull the lift hook laterally and move the lower sheave block out of its desired vertical alignment with the upper sheave block. This condition is generally referred to as "side pull". If side pull exists the load will abruptly swing laterally to a plumb position when it loses contact with the floor. Side pull can result in damage to the load, to the hoist and to adjacent structure as well as possible injury to workers. The operator, from a position high above the factory floor, finds it very difficult to determine if a side pull condition exists.

SUMMARY OF THE INVENTION

A need exists for a simple, reliable and rugged, low cost indicating device that will instantaneously warn a crane operator of side pull and the direction of side pull before a load is actually lifted. It is also desirable that such an indicating device be substantially unaffected by dirty air or dirt accumulation on the crane. The present invention provides an indicating device that warns the operator when side pull exists and the direction of the side pull.

The indicating device includes a pivotal member mounted on a base plate attached to the frame of the trolley on which the hoist is supported, and a pair of spaced apart projections extending from the pivotal member and between which a rope for lifting a load is disposed at a desired orientation relative to the vertical. Movement of the rope from the desired orientation will cause it to engage one of the rods and move the rod along with the pivotal member in one of two opposite directions depending on the direction of movement of the rope from its desired orientation. A fixed member is also mounted on the base plate and is positioned in the direction of movement of the pivotal member. A sensing means is mounted on the fixed member and is responsive to movement of the pivotal member when engaged and moved by the rope to indicate the movement and direction of the pivotal member and thereby the movement and direction of movement of the rope from the desired orientation.

The indicating device may include a second fixed member such that there are first and second fixed members respectively positioned on opposite sides of the pivotal member so that movement of the rope from its desired orientation in a first direction will also move the pivotal member in the first direction toward the first fixed member and adjacent to or into engagement with the sensing means. On the other hand, movement of the rope and thereby the pivotal member in a second opposite direction will move the pivotal member into engagement with the sensing means to result in an indication of the movement of the rope in the second direction from its desired orientation.

Each fixed member is adjustable by means of a slot in the fixed member and a threaded bolt extending through the slot and into the base plate. The mounting of the pivotal member and each fixed member is preferably at a single mounting location on the frame.

A plurality of rollers are attached to the base plate and positioned parallel to the pivotal movement direction of the pivotal means. The rollers rotatably engage the pivotal member to maintain it in a parallel spaced position relative to the base plate and facilitate the pivotal movement of the member.

BRIEF DESCRIPTION OF THE DRAWINGS

Further objects and advantages of the invention will appear when taken in conjunction with the accompanying drawings in which.

DESCRIPTION OF THE PREFERRED EMBODIMENT

Figure 1:
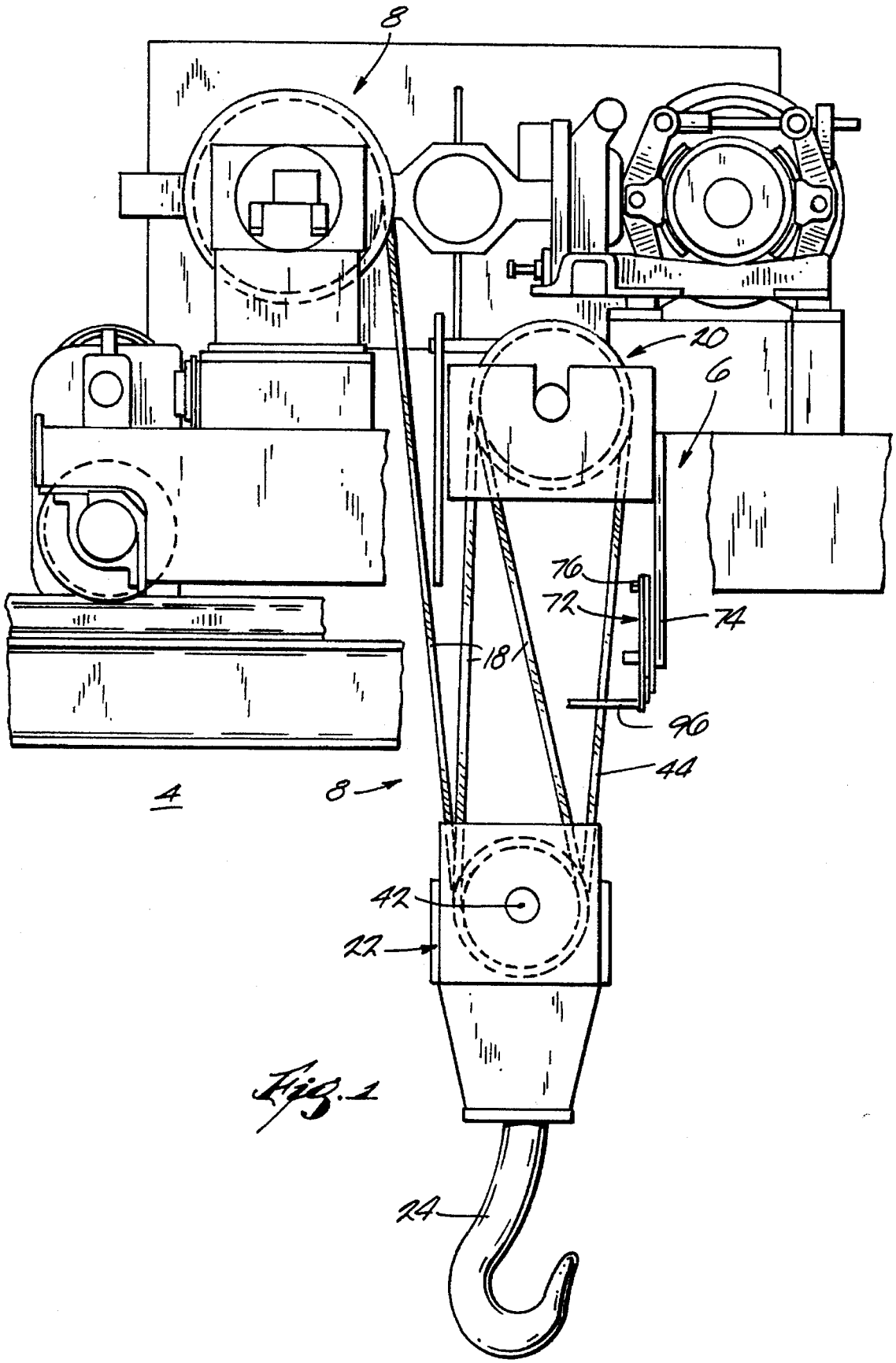
FIG. 1 is a side elevation view of a trolley supported on a crane and incorporating an indicating device according to the invention.

Shown in FIG. 1 is an overhead crane 2 comprising a trolley 4, including wheels 12 and a hoist mechanism 8. The trolley is supported on its wheels 12 for travel along spaced apart rails 14 comprising part of the crane. The hoist mechanism 8 includes a rope 18, a frame 6, and moves with the trolley to place the hoist mechanism 8 above a load (not shown) that is to be lifted by the rope 18. The hoist mechanism 8 also includes an indicating device 10 for detecting or sensing side pull on the rope 18.

Figure 2:
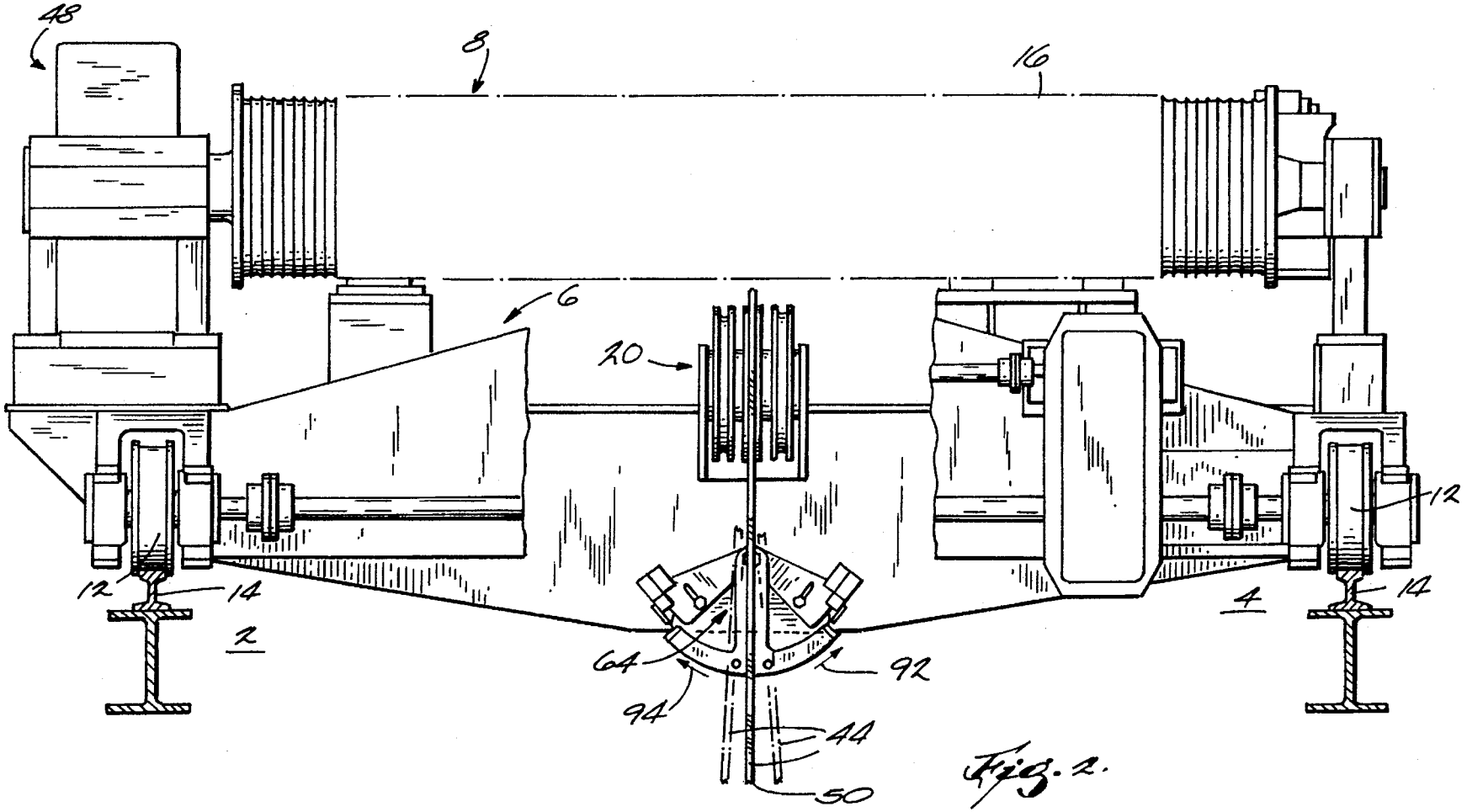
FIG. 2 is a front elevation view of the trolley shown in FIG. 1.
Figure 6:
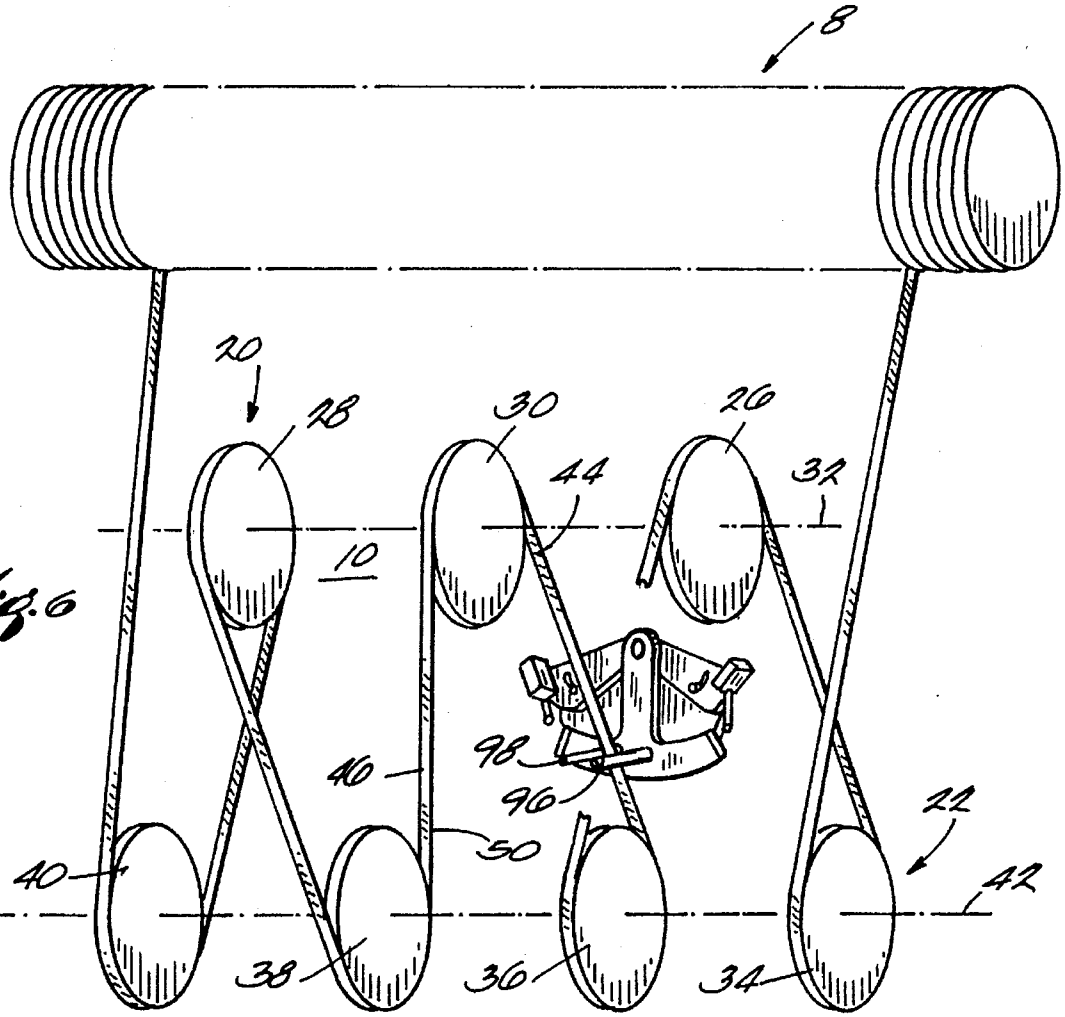
FIG. 6 is a perspective view of the drum, sheaves and rope carried by the trolley on Which the indicating device of the invention is utilized.

Referring to FIGS. 1, 2 and 6, the hoist mechanism 8 includes, in addition to those components previously described, a rotatable hoist drum 16 to which the rope 18 is attached, upper and lower sheave block assemblies 20 and 22 through which the rope 18 is reeved, and a load lifting hook 24 connected to the lower block assembly 22. More specifically, particularly with reference to FIG. 6, the upper block assembly 20 includes upper outer sheaves 26 and 28, and an equalizing sheave 30 mounted for rotation about upper axis 32. The bottom sheave assembly 21 includes lower sheaves 34, 36, 38 and 40 mounted for rotation about lower axis 42. The wire rope 18 includes equalizing rope runs 44 and 46 trained from equalizing sheave 30 to sheaves 38 and 36, respectively. The sheave 30 does not rotate and the runs 44, 46 do not move axially when the drum 16 rotates except for intermittent small movements to equalize loading in the rope and sheave reeving system. The other sheaves 28, 32, 34, 36, 38, 40 rotate and the other runs move axially when the drum 16 rotates. The wire rope 18 is flexible and permits the lateral shifting of hook 24 in any direction.

The hoist mechanism 8 further includes a conventional prime mover such as drive motor 48 connection through a gear train (not shown) in a known manner for rotating the hoist drum 16. Referring to FIGS. 1 and 2, the crane 2 includes an operator's station at which are located controls electrically connected to operate the crane 2, trolley 4 and hoist mechanism 8. The operation in general includes the positioning of the crane and trolley so that the hoist 8 is above a location at which a load is to be lifted or deposited, and the rotation of the hoist drum 16 to unwind rope from or wind rope on to the drum to thereby raise the lower sheave block assembly 20, the hook 24 and any load connected to the hook. This operation of the crane, trolley and hoist is well known and will not be further disclosed.

With reference to FIGS. 1–6, the indicating device 10 includes a base plate 64 mounted on the hoist frame 6. The indicating device 10 further includes arms 66 and 68 on which sensing means 70 is mounted and a pivotal trip plate or member 72. The arms 66 and 68 and trip plate 72 are all supported at a single location 74 on the base plate 64 by a single fastening means 76 such as a threaded stud and nuts and washer. The trip plate 72 is parallel to and separated from the most adjacent arm 68 by a washer 78 and is also spaced from the base plate 64 (see FIG. 4). The trip plate has an inverted substantially T-shape with a center member 80 depending from the fastening means 76 and a cross member 82 in engagement with a plurality of rollers 84 mounted on the base plate 64. The trip plate 72 is pivotally moveable in planes parallel to the base plate 64 in opposite directions illustrated by the arrows 92 and 94 in FIGS. 2 and 3 with the cross member 82 moving along an arc 86 of a circle. The rollers 84 rotate about axes 88 each lying along a radius 90 of the arc 86. As shown particularly in FIGS. 4 and 5, each roller 84 rotatably supports the trip-plate 72 to maintain the parallel spacing of the trip plate with the base plate 64 and facilitate the pivotal movement of the trip plate along the path of the arc 86. Projecting from the trip plate 72 in the area of the intersection of the center member 80 and cross member 82 are a pair of spaced apart rods 96 and 98 between which the wire rope 18 is positioned during operation of the hoist.

The arms 66 and 68 respectively have upper ends 100 and 102 in engagement with each other and attached to the fastening means 76. The arms 66 and 68 diverge from each other in a downward direction and respectively have lower spaced apart ends 104 and 106. The arms 66 and 68 respectively also have slots 108 and 110 extending through the arms with each slot having a length substantially parallel to the arc 86. Extending through the slot 108 is a bolt 112 and through the slot 110 is a bolt 114 which each thread into the base plate 64. The bolts 112 and 114 hold the arm through which they extend at a selected position relative to the cross member 82 of the trip plate and with the arm lower ends 104 and 106 spaced apart from each other.

The sensing mean 70 includes a limit switch 116 mounted on the arm 66 and a limit switch 118 mounted on the arm 68. The limit switch 116 includes a switch arm 120 positioned in the path of the pivotal movement of the cross member 82 of trip plate 72 when the cross member 82 is moving along the arc 86 in direction 92. The switch arm 120 is moveable from position a shown in phantom lines in FIG. 4 to position b shown in full lines when engaged by the cross member 82 during pivotal movement of the trip plate 72 in direction 92. The limit switch 116 is responsive to the movement of the arm 120 to position b to provide an indication that the trip plate 72 has moved in direction 92 into engagement with the limit switch 116. The limit switch 118 and its switch arm 122 operate in the same manner as switch 116 and arm 120 when the trip plate 72 pivots in direction 94 to cause the cross member 82 to engage the switch arm 122, as shown in phantom lines in FIG. 3, to produce an indication of such movement of the trip plate in direction 94 and engagement of the arm 122. The slot 108 through arm 66 and the bolt 112 permit adjustment of the arm 66 and thereby the limit switch 116 so that the distance of travel of the trip plate 72 in the direction 92 can be selected as desired. Similarly, the slot 110 through arm 68 and the bolt 114 permit adjustment of the arm 68 to select the movement of the trip plate in direction 94 to engage the switch arm 122 and cause the limit switch 118 to produce said indication.

Figures 3, 5:
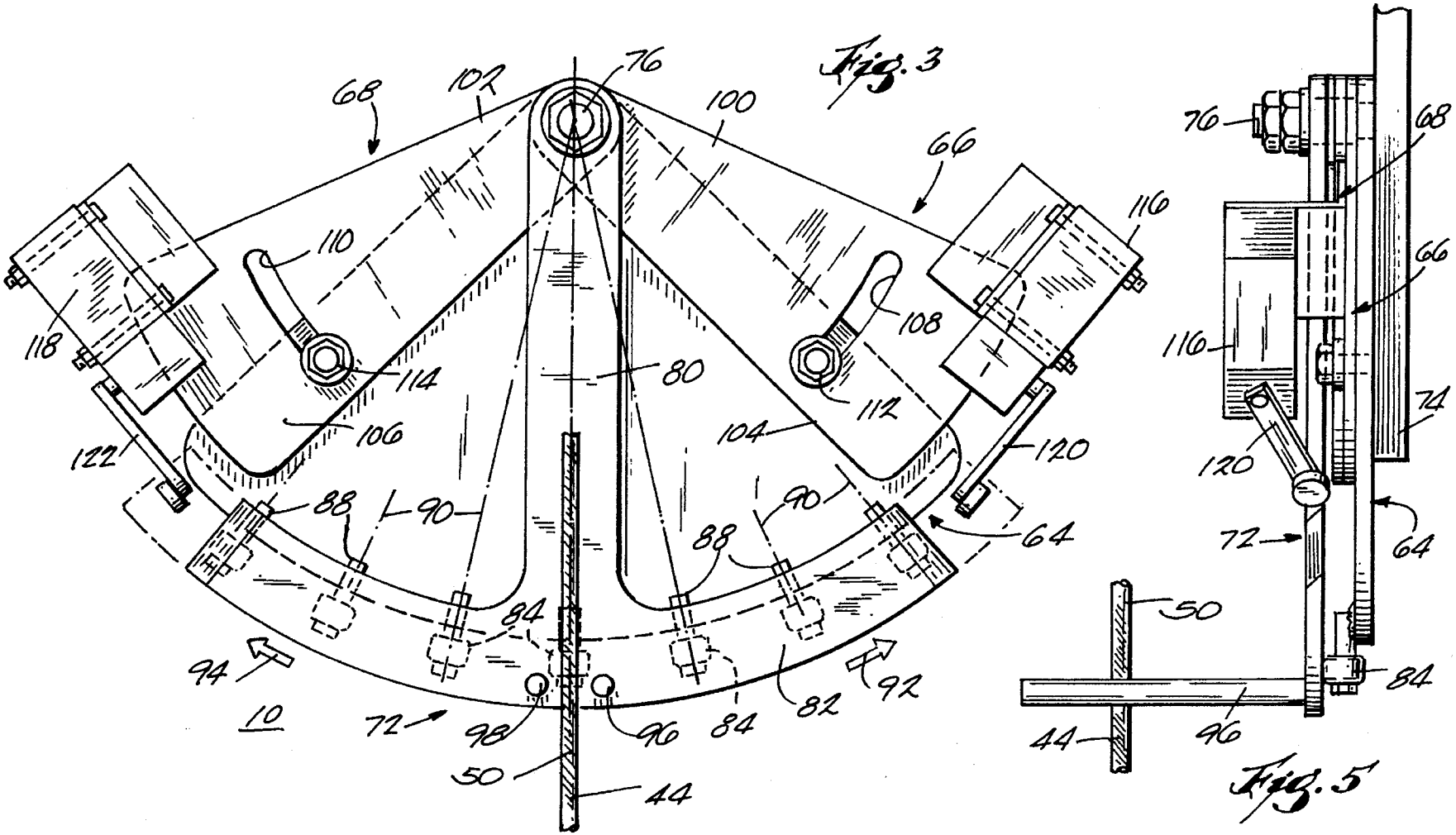
FIG. 3 is a front elevation view of the indicating device according to the invention.
FIG. 5 is a side elevation view of the indicating device shown in FIG. 3.
Figure 4:
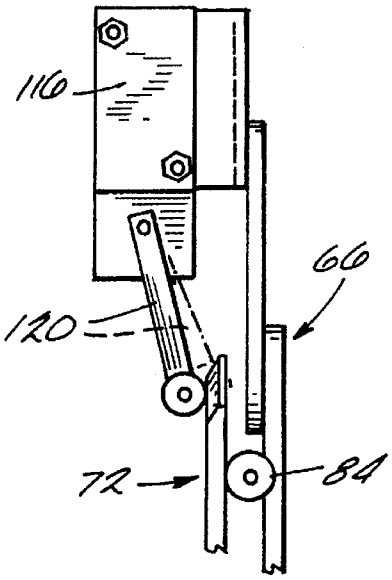
FIG. 4 is a side elevation view of a portion of the indicating device shown in FIG. 3.

In operation, as long as the lower shift block assembly 22 remains vertically aligned below upper shift block assembly 20, i.e., when no side pull exists, the rope 18 will be in its desired orientation 50 as shown in FIGS. 2 and 3. This orientation is typically vertical relative to the directions 92 and 94 shown in FIGS. 2 and 3. In this orientation of the rope 18, the space between the rods 96 and 98 is preferably vertically below the fastening means 76. The trip plate 72 will then be in a position such that the cross member 82 does not move either of the switch arms 120 and 122 to indicate a side pull condition and thus movement of the rope 18 from its desired orientation. However, if the lower sheave block assembly 22 moves out of vertical alignment with the upper sheave block assembly 20, for example, such that the rope 18 moves from its desired orientation 50 in the direction 94, the rope will bear against the rod 98 and thereby move the trip plate 72 into engagement with the switch arm 122 to cause the switch 118 to produce an indication that the rope has moved in direction 94 from its desired orientation 50. (Refer to FIG. 5 also). If the lower sheave block 22 moves out of vertical alignment with the upper sheave block 20 such that the rope 18 moves from its desired orientation 5 in the direction 92, the trip plate 72 will be moved by engagement of the rope 18 against the rod 96 in the direction 92 to cause the cross member 82 to engage the switch arm 120 to cause the limit switch 116 to produce an indication of the movement of the rope from its desired orientation in direction 92.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. In a hoist having a frame and a rope depending from the hoist at a desired orientation, an indicating device for detecting lateral shifting of the rope from the desired orientation comprising:

a fixed member mounted on the frame;

a pivotal member mounted on the fixed member and having a pair of spaced apart projections between which the depending rope extends, the pivotal member being engaged by and pivotally movable with the rope upon movement of the rope from the desired orientation;

a plurality of rollers mounted on the fixed member in engagement with the pivotal member and rotatable in the direction of pivotal movement of the pivotal member to facilitate such movement; and sensing means mounted on the fixed number and responsive to movement of the pivotal member to indicate such movement and thereby the movement of the rope from the desired orientation.

2. The indicating device according to claim 1 wherein:

the fixed member includes first and second arms respectively having first and second means for adjusting the positions of the arms relative to the pivotal member;

the sensing means includes first and second spaced apart actuating arms respectively mounted on the first and second arms and each movable to produce said indication; and the pivotal member is movable in opposite directions into engagement with either one of the actuating arms to move the latter whereby said indication is produced.

3. In a hoist having a frame, sheave means, a rope depending from the sheave means at a desired orientation, load holding means attached to a lower section of the rope and a drum rotatable to wind the rope onto and unwind the rope from the drum through the sheave means to thereby raise and lower the load holding means, an indicating device for detecting lateral shifting of the rope from the desired orientation comprising:

a plate mounted vertically on the frame;

a pivotal member mounted on the plate and pivotally movable in opposite directions along a path parallel to the plate;

a pair of spaced apart rods projecting from the pivotal member transversely to the movement directions of the pivotal member;

the rope extending between the rods and being movable from its desired orientation during operation of the hoist in engagement with the rods to pivotally move the rods and pivotal member in said directions;

first and second arms mounted on the plate and including upper ends adjacent each other and lower ends spaced apart in directions parallel to the movement directions of the pivotal member, each of the arms having slot means for adjusting the position of the lower ends of the arms; and first and second sensing means respectively mounted on each of the first and second arms in the path of one of the opposite directions of movement of the pivotal member, one of the sensing means being engaged by the pivotal member during such movement and being responsive to such movement to indicate movement of the rope from its desired orientation.

4. The indicating device according to claim 3 wherein the pivotal member and the first and second arms are mounted on the plate by the same fastening device.

5. The indicating device according to claim 4 wherein the plate, the pivotal member and the first and second arms are mounted at a single location on the frame.

6. The indicating device according to claim 4 wherein:

the pivotal member is pivotally movable along a circular arc in said opposite directions; and further comprising a plurality of spaced apart rollers mounted on the plate along the circular arc with the axis of the rollers lying along a radius of the circular arc, the rollers being in supporting engagement with the pivotal member during its pivotal movement along the circular arc.

7. The indicating device according to claim 6 wherein the pivotal member has an inverted substantially T-shape with a cross member engaging the rollers.

8. The indicating device according to claim 6 wherein the slot means comprises:

first and second slots respectively through the first and second arms and extending parallel to the circular arc; and removable fastening means through the slots into the plate to hold the first and second arms and the sensing means in selected positions relative to the pivotal member whereby the extent of movement of the rope from its desired orientation and the consequent movement of the pivotal member which produces an indication from the sensing means is determined by the selected positions of the first and second arms and sensing means.

9. The indicating device according to claim 8 wherein the pivotal member has an inverted substantially T-shape.

10. The indicating device according to claim 3 wherein:

the pivotal member is pivotally movable along a circular arc in said opposite directions; and further comprising a plurality of spaced apart rollers mounted on the plate along the circular arc with the axis of the rollers lying along a radius of the circular arc, the rollers being in supporting engagement with the pivotal member during its pivotal movement along the circular arc.

11. The indicating device according to claim 10 wherein the pivotal member has an inverted substantially T-shape with a cross member engaging the rollers.

12. The indicating device according to claim 3 wherein the first and second arms and the pivotal member are superimposed on the plate.

13. The indicating device according to claim 3 wherein the first sensing means indicates only its engagement by the pivotal member when the rope and pivotal member move in one of said directions and the second sensing means indicates only its engagement by the pivotal member when the rope and pivotal member move in the other of said directions.

14. In a hoist having a frame and a rope depending from the hoist at a desired orientation, an indicating device for detecting lateral shifting of the rope from the desired orientation comprising:

a fixed member mounted on the frame;

a pivotal member mounted on the fixed member and having a pair of spaced apart projections between which the depending rope extends, the pivotal member being engaged by and pivotally movable in opposite directions with the rope upon movement of the rope from the desired orientation;

first and second arms mounted on the frame and respectively having first and second means for adjusting the positions of the arms; and sensing means mounted on the fixed member and including first and second spaced apart actuating arms respectively mounted on the first and second arms and each engageable by and movable with the pivotable member to indicate the movement of the pivotable member and thereby the movement of the rope from the desired orientation.

* * * * *